United States Patent [19]

McCoy et al.

[11] Patent Number: 5,072,747

[45] Date of Patent: Dec. 17, 1991

[54] APPARATUS AND METHOD FOR CLEANING TUBULAR ARTICLES

[75] Inventors: John W. McCoy, Elmwood Park, N.J.; Wayne Steenrod, Monroe, N.Y.

[73] Assignee: Avon Products, Inc., New York, N.Y.

[21] Appl. No.: 356,960

[22] Filed: May 26, 1989

[51] Int. Cl.[5] ..... B08B 9/02

[52] U.S. Cl. ..... 134/48; 134/21; 134/22.11; 134/25.4; 134/61; 134/84

[58] Field of Search ..... 134/25.4, 25.1, 21, 134/48; 15/304, 302; 34/15, 61, 64 R, 84

[56] References Cited

U.S. PATENT DOCUMENTS

| | | | |
|---|---|---|---|
| 3,601,242 | 8/1971 | Reinemuth | 198/459 |
| 3,866,737 | 2/1975 | Simon | 198/470.1 |
| 3,922,750 | 12/1975 | Cioni et al. | 15/304 |
| 4,017,330 | 4/1977 | Aidlin et al. | 134/21 |

*Primary Examiner*—Anthony McFarlane

*Attorney, Agent, or Firm*—S. Michael Bender

[57] ABSTRACT

A pre-soak station, a washing station, and a drying station are arranged in an in-line manner so that a multiplicity or group of mold support units or workpiece holders arranged single file may be moved sequentially from station to station. A first group of such units after being submersed in a hot water/detergent bath at the pre-soak station is placed on an open rail support or trackway for conveyance to the washing station where nozzles supported on corresponding manifolds surrounding the trackway direct pressurized streams of hot water against the individual units for a predetermined interval or washing cycle. The group of washed units are then conveyed along the same trackway to a tray supported within the interior of a drying chamber having movable baffle means for directing forced, heated air through the interior of each mold or mold support unit during the initial portion of the drying cycle, and for directing the forced, heated air against the top and exterior side portions of each unit during a second or later portion of the drying cycle upon selective movement of the baffle means from a first position to a second position. A plenum defining a surface for supporting the mold support units in their tray in the drying station is connected to a vacuum pump to facilitate rapid and effective drying during both phases of the drying cycle. A hinged door in the assembly comprising the baffle means facilitates removal of the tray housing the dried units so that a subsequent tray may be inserted into the drying station for receiving the next group of units to be dried.

15 Claims, 7 Drawing Sheets

APPARATUS AND METHOD FOR CLEANING TUBULAR ARTICLES

TECHNICAL FIELD

The present invention relates generally to an apparatus and method for cleaning tubular articles, and more specifically to an apparatus and method for cleaning tubular articles in the form of molds or workpiece holders employed in the manufacture of cosmetic tubular articles such as pomades or lipsticks.

BACKGROUND ART

In co-pending application, Ser. No. 336,378, filed Apr. 11, 1989, assigned to the same assignee as the present invention, there is fully disclosed an automatic method and apparatus for manufacturing cosmetic tubular articles such as pomades and lipsticks. During the various stages of the manufacturing process, as disclosed in this application, individual pomades or lipsticks are transported in either molds carried in corresponding support units or workpiece holders both of which, in turn, are moved continuously from one station to another via conveyer belts or similar transporting means. As further disclosed in application Ser. No. 336,378, a line of mold support units carrying molded pomades or lipsticks and a line of empty workpiece holders are fed separately into an "extractor" wherein the pomades or lipsticks carried by the mold support units automatically are transferred to corresponding workpiece holders. After exiting the extractor, the empty mold support units are recycled; that is, they are returned to a first station where new, empty lipstick tubes are inserted into the molds on the mold support units, then moved to a second or "hot pour" station where a charge of molten pomade is poured into each mold and the lipstick tube therein, and then finally, conveyed back to the extractor for transfer to a corresponding workpiece holder. Likewise, the workpiece holders exiting the extractor with the lipsticks therein are recycled by being conveyed first to a variety of finishing stations, then to a packing station where the finished lipsticks are removed from their workpiece holders and placed in suitable packaging. The empty workpiece holders then are conveyed back to the extractor to pick up new pomades or lipsticks.

As a result of this recycling process, the mold support units and workpiece holders gradually become caked with pomade material and other debris and periodically must be removed from the automatic lipstick manufacturing line for cleaning and refurbishment. Heretofore, such cleaning was accomplished by hand utilizing hot water, a suitable detergent and vigorous manual brushing (i.e. elbow grease). This prior hand process not only was time consuming and therefor expensive, but frequently failed to adequately remove all of the "caked" pomade material from a particular mold or mold support unit especially where so-called "split mold" units were involved.

Against this background, it is the primary object of the present invention to provide a means and method for effectively and efficiently cleaning a multiplicity of mold support units or workpiece holders which latter are utilized in the manufacture of pomade or lipsticks. It is yet another object of the present invention to provide an apparatus and method for effectively and efficiently cleaning such mold support units particularly if they are of the "split mold" variety.

DISCLOSURE OF THE INVENTION

Toward the accomplishment of the above and additional objects and advantages, the apparatus of the present invention, briefly described, comprises a pre-soak station, a washing station, and a drying station arranged in an in-line manner so that a multiplicity or group of mold support units or workpiece holders arranged single file may be moved sequentially from station to station. A first group of such units is supported or otherwise contained in a tray submersed in a hot water/detergent bath at the pre-soak station. The units are then removed from the tray and placed on an open rail support or trackway for conveyance to the washing station where nozzles supported on corresponding manifolds surrounding the trackway direct pressurized streams of hot water against the individual units for a predetermined interval or washing cycle. The group of washed units are then conveyed along the same trackway to a tray supported within the interior of a drying chamber having movable baffle means for directing forced, heated air through the interior of each mold or mold support unit during the initial portion of the drying cycle, and for directing the forced, heated air against the top and exterior side portions of each unit during a second or later portion of the drying cycle upon selective movement of the baffle means from a first position to a second position. A plenum defining a surface for supporting the mold support units in their tray in the drying station is connected to a vacuum pump to facilitate rapid and effective drying during both phases of the drying cycle. A hinged door in the assembly comprising the baffle means facilitates removal of the tray housing the dried units so that a subsequent tray may be inserted into the drying station for receiving the next group of units to be dried.

BRIEF DESCRIPTION OF THE DRAWINGS

Still further objects and advantages of the present invention, as well as a more complete understanding of same, will become more apparent from a study of the following detailed description of the preferred embodiments thereof in connection with the accompanying drawings wherein.

BEST MODE OF CARRYING OUT INVENTION

Before describing in detail the preferred form of cleaning apparatus according to the present invention, it might be helpful to generally describe an automated line for making tubular articles such as pomades or lipsticks in conjunction with which apparatus of the present invention advantageously may be utilized. A typical automatic lipstick manufacturing line diagrammatically is depicted in FIG. 1 and comprises a first station 10 where unfilled pomade or lipstick tubes or containers 12, are placed respectively in molds 14 each carried in its own mold support unit 16.

Figure 2:
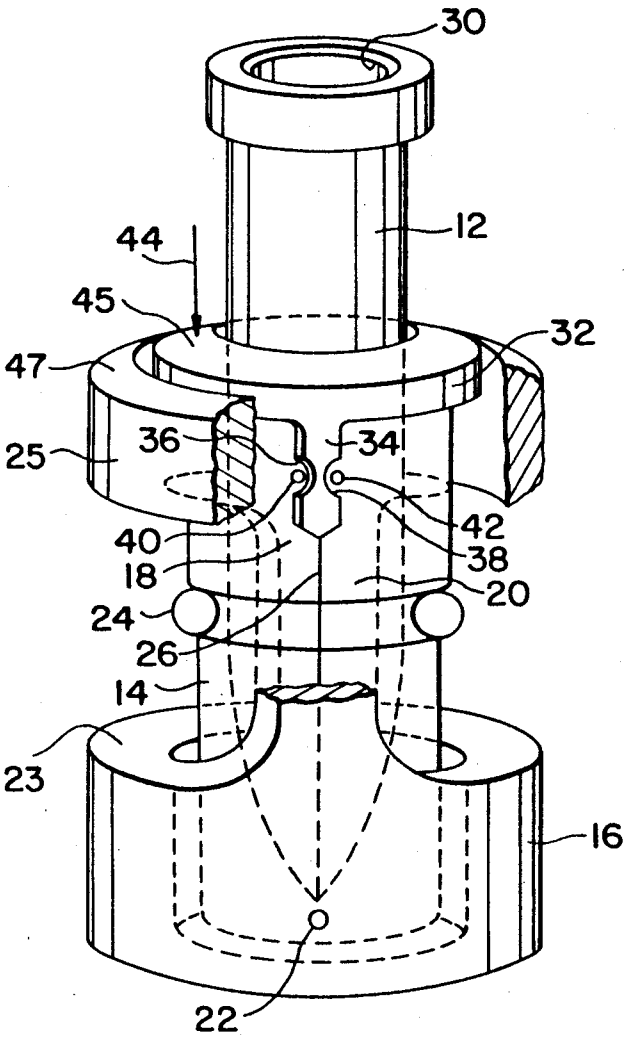
FIG. 2 is a perspective view partially broken away showing the preferred form of split mold and mold support unit adapted to be cleaned by the apparatus of the present invention.

As more particularly illustrated in FIG. 2, each mold 14 preferably is of the so-called "split mold" type and accordingly, consists of a pair of mirror-image mold sections 18, 20 hinged together at their bottom-most extents by a pin 22 mounted in the hollow cylindrical base 23 of mold support unit 16 and extending through the cylindrically shaped sidewall thereof substantially as depicted. Each mold support unit 16 comprises a generally cylindrically shaped hollow body member having an upper section 25 connected to lower or base section 23 by a pair of diametrically opposed vertically oriented arm sections only one of which is partially shown in FIG. 2. The two mold halves 18, 20 normally are maintained in a closed condition by the action of circumferential spring 24, but may split or separate along parting line 26 against the action of spring 24 to effect release of container 12 and any molded pomade 28 inside the container 12 and the mold 14. A hole 30 provided in the bottom of container 12 permits insertion of a feed tube for charging the interior of the mold and the container with molten pomade as is well known and more fully described in U.S. Pat. No. 4,051,878, the disclosure of which is hereby incorporated herein.

A depressible ring 32 floats above the mold sections 18 20 by means of a pair of diametrically opposed downwardly depending arms 34 (only one shown) with the ring being concentrically disposed within the central opening of the hollow upper body portion 25 of each mold support unit 16. Each arm has a pair of opposed notches 36, 38 for receiving a corresponding pair of pins 40, 42 fixed to each mold section, respectively, as shown. The action of circumferential spring 24 normally causes the pins to seat within their corresponding notches thereby maintaining the ring 32 in its normal floating condition. However, downward movement of the ring 32 as indicated by arrow 44 will cause the opposed edges of each arm to cam the pins 40, 42 apart thereby causing the mold sections 18, 20 to separate along parting line 26 by pivoting relative to each other about the axis defined by pin 22, thus opening the mold for release of container 12 and molded pomade 28. It will be understood that in the closed position of the mold when the pins 40, 42 are seated within their corresponding notches 36, 38, the top surface 45 of ring 32 extends above top surface 47 of the upper body portion 23 of mold support unit 16 a sufficient distance so that when ring 32 is depressed in the direction of arrow 44 and brought flush with surface 47, arms 34 have completely cammed apart pins 40, 42.

Figure 1:
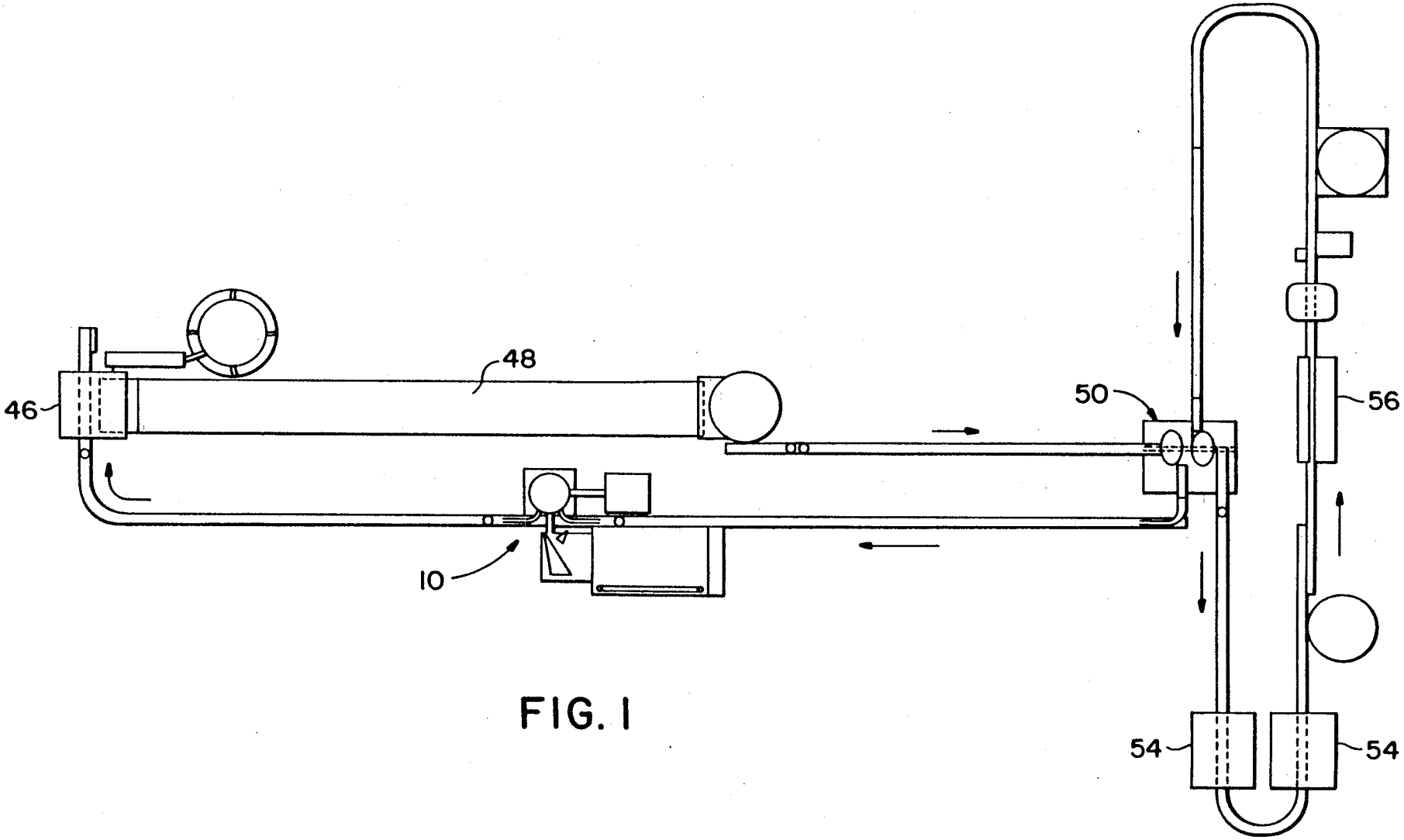
FIG. 1 is a schematic diagram in plan view of an automated line for manufacturing pomades or lipsticks.

The empty tubes or containers 12 of FIG. 2 in their separate molds 14 and mold support units 16 are caused to move along a suitable conveyer in the upright position to station 46 of FIG. 1 where the containers and the molds are filled with hot liquid pomade as disclosed, for example, in U.S. Pat. No. 4,051,878, supra. After filling, the mold support units are passed through a cooling tunnel 48 and then delivered, in the upright position of FIG. 2, to the extractor apparatus of the present invention generally indicated by reference numeral 50.

Figure 3:
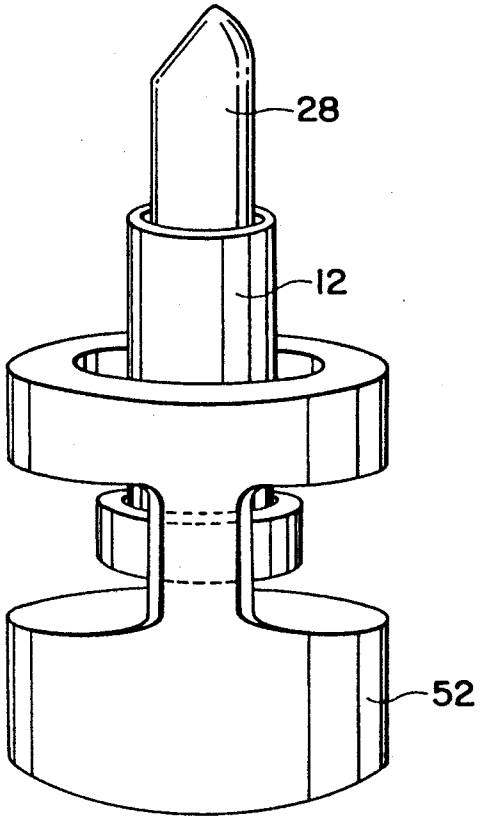
FIG. 3 is a perspective view showing the preferred form of workpiece holder adapted to be cleaned by the apparatus of the present invention.

The function of extractor apparatus 50 is to automatically remove (extract) the filled containers 12 with their molded pomades 28 from the molds 14 and mold support units 16 one by one in rapid sequence, and insert same into corresponding workpiece holders 52 in the inverted position substantially as shown in FIG. 3; that is, with the workpiece holders and the pomade portions of the articles being in the upright position so that the articles may be conveyed to stations 54 and 56 (FIG. 1) for further processing. For example, at station 54 the pomade 28 may be "flashed," whereas at station 56 the container 12 may be capped, removed from its workpiece holder 52, and packaged. Each workpiece holder 52 is similar to a mold support unit 16 and comprises a hollow cylindrical upper body portion 55 connected to a lower cylindical base portion 57 by a pair of diametrically opposed upstanding vertical arm portions (only one being shown). However, in the case of the workpiece holders, the lower body portion preferably is solid to form a support or shelf for the bottom of lipstick container 12. After the filled lipstick containers are removed from the workpiece holders at the finishing station 56, the empty workpiece holders 52 are recycled by being conveyed back to extractor 50. In addition, extractor apparatus 50 continuously discharges empty mold support units 16 which are recycled by being conveyed back to station 10 (FIG. 1).

The details of the extractor 50 are outside the scope of the present invention and unnecessary for a complete understanding thereof. Nonetheless, the interested reader is referred to copending application, Ser. No. 336,378, supra, which latter is hereby incorporated herein by this reference. Suffice it to say that as a result of the operation of extractor 50, the same molds and mold support units and workpiece holders may be used over and over again through many cycles of the operation of the automatic lipstick manufacturing line of FIG. 1. As a result of such recurring use, the molds 14 and mold support units 16, and workpiece holders 52 gradually accumulate caked or filmy deposits of pomade material, machine oil, dust and other debris, eventually requiring their removal from the line for cleaning. This is especially so when there is a color change at station 46 since smudges or deposits of the first color will soon begin to appear on filled lipsticks or pomades of the second or different color thereby producing rejects. Also, build-up of pomade material on the mold units may cause jamming of the extractor 50. In the case of "split mold" units, deposits of pomade material often lodge in the parting line sections of the two mold halves and ordinarily, are extremely difficult to remove.

Hence, after a predetermined number of cycles of the lipstick line of FIG. 1 and especially before a color change on the line, it is contemplated that a multiplicity of individual mold support units 16 (with their molds 14) and/or workpiece holders 52 will be removed from the line and transported by suitable means such as a trolley wagon, for example, to the off-line cleaning apparatus of the present invention which preferably is located conveniently in a separate work space away from the automatic lipstick manufacturing line.

Figure 4:
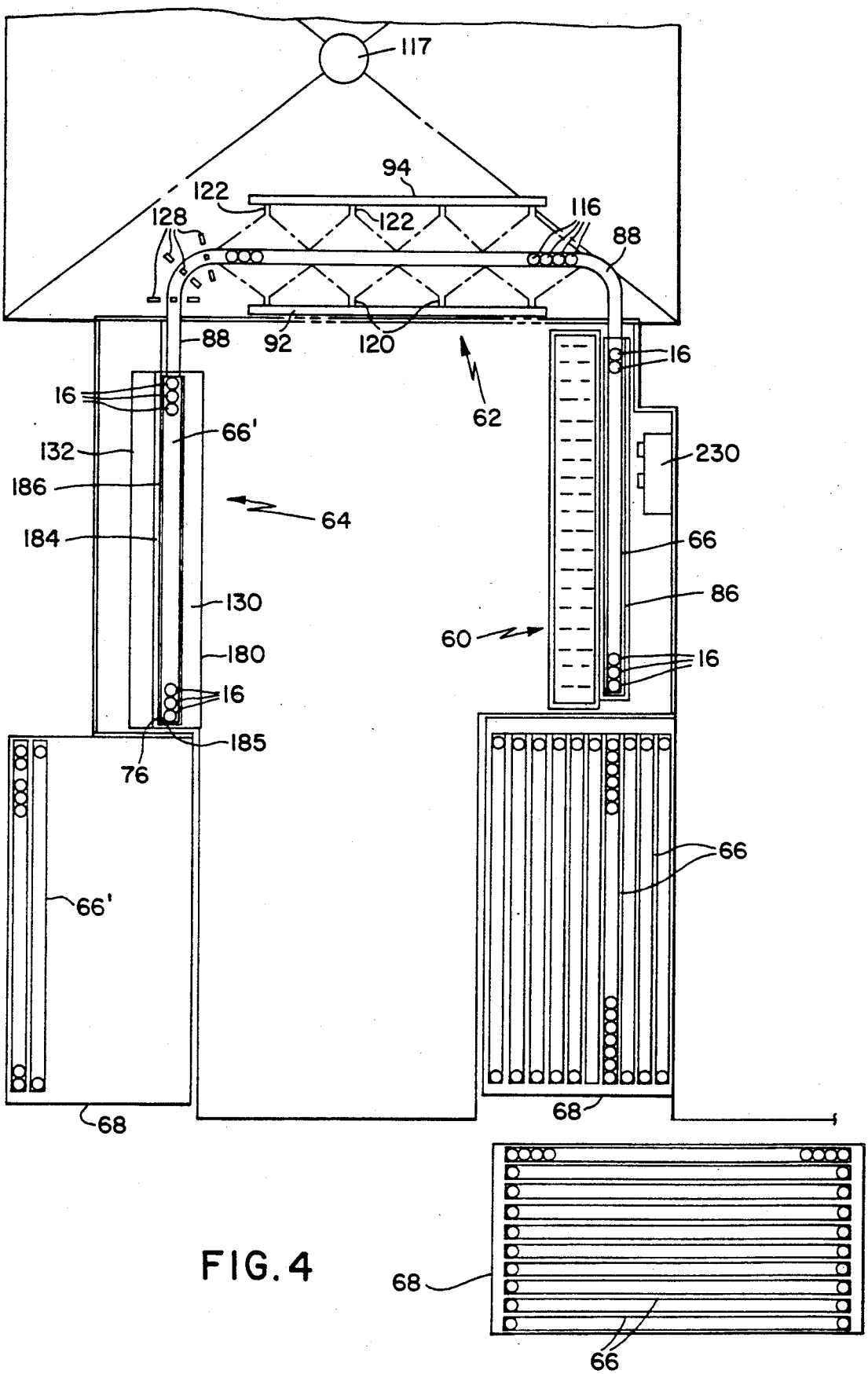
FIG. 4 is plan view schematically showing the cleaning apparatus of the present invention.

Turning initially to FIG. 4, the cleaning apparatus of the present invention, in its preferred form, comprises a presoak station 60, a washing station 62 and a drying station 64 arranged side-by-side in a generally U-shaped configuration (as schematically depicted in FIG. 4) to make maximum effective use of floor space.

The mold support units 16 with their molds 14 and/or workpiece holders 52 to be cleaned are removed by hand from the lipstick line (FIG. 1) and placed in longitudinally extending, rectangular shaped channels or trays 66 supported for movement on a trolley 68 or similar wheeled conveyance. The trolley 68 then is wheeled to the cleaning apparatus of the present invention and placed in an off-loading position adjacent presoak station 60 where several trays 66 containing units to be cleaned are immersed in a tank or tub 70 containing hot water and detergent and allowed to soak for a predetermined interval of time such as, for example, 2–10 minutes before the units are conveyed to washing section 62 as will be explained below.

Figure 5:
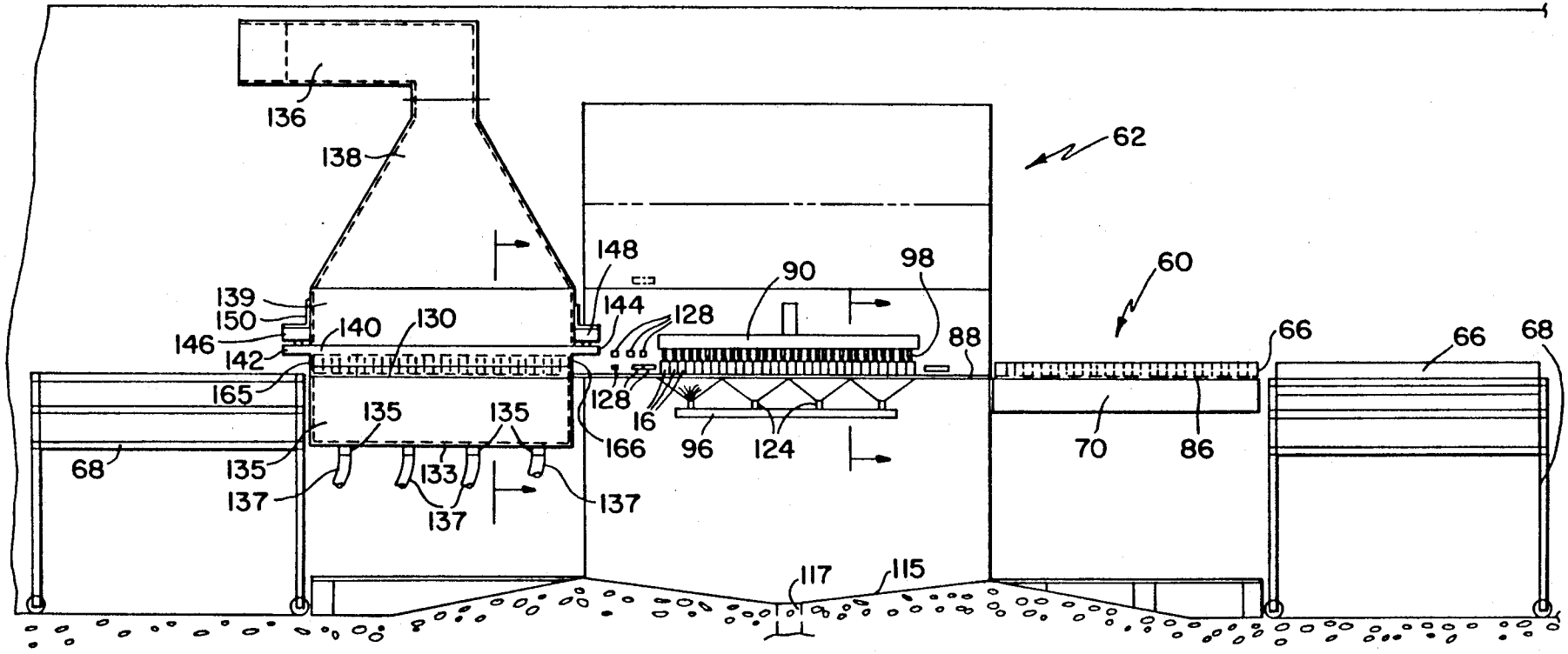
FIG. 5 is a view in elevation schematically showing the cleaning apparatus of FIG. 4 in unfolded aspect so as to appear in one plane.

In FIG. 5, the u-shaped configuration of the cleaning apparatus of FIG. 4 is shown unfolded in elevation for the sake of clarity and to fully describe the invention.

Figure 6:
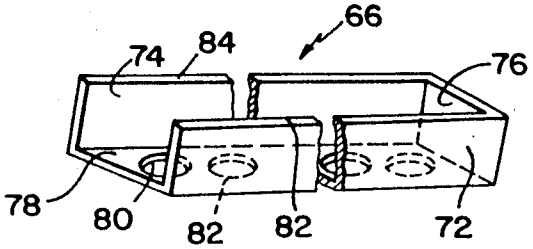
FIG. 6 is a perspective view of the preferred form of tray used in the apparatus of the present invention.

As seen in FIG. 6, each longitudinally extending tray 66 has a pair of opposed longitudinally extending sidewalls 72, 74, a transverse end wall 76 and a longitudinally extending bottom or floor 78. It will be noted that tray 66 has only one transverse end wall 76 and is open at its opposite end therefrom. Also, the floor 78 of the tray includes a series of perforations or through holes 80 evenly spaced along the longitudinal axis of the tray. Each tray 66 is so dimensioned that a multiplicity of mold support units 16 (with their individual molds 14) may be received therein in a single-file abutting manner such that the perforations 80 in the floor 78 of the tray line-up or communicate with the central opening in each mold support unit (see FIG. 8). In addition, and as also best seen in FIG. 8, the height of sidewall 72, 74 of tray 66 is such that the depressible ring 32 on each mold unit 14 extends above the top edges 82, 84 of sidewalls 72, 74. In the preferred embodiment, and without limiting the present invention, each tray is approximately 45" in longitudinal extent and contains 24 evenly spaced perforations 80 in floor 78 each having a diameter of about 0.5 inches. Thus, each tray 66 is capable of holding or containing 30 mold support units in abutting single-file arrangement. In this regard, it will be appreciated that the length of each tray, the number of perforations therein (and therefore the capacity of each tray) is a matter of design convenience.

After being soaked in tub 70, a single tray 66 containing a group of incompletely cleaned mold/mold support units is placed on a shelf 86 provided rearwardly along the back side edge of tub 70 and extending parallel thereto. The tray 66 is so positioned on shelf 86 such that its open end is aligned with and confronts the initial portion of an open framework or trackway 88 level with shelf 86 and extending longitudinally and horizontally through washing station 62 all the way to drying station 64. Thus, the group or set of mold support units 16 contained in tray 66 on shelf 86 may be slid through the open end of the tray and onto open trackway 88 for conveyence first to washing station 62 and ultimately to drying station 64.

The washing station 62 comprises a series or array of hot water manifolds 90, 92, 94 and 96 surrounding the open trackway 88 and extending parallel thereto with manifold 90 being positioned above the trackway; manifolds 92, 94 being respectively positioned laterally to the front and rear of the trackway; and manifold 96 being positioned below the trackway. Manifold 90 has mounted therein a row of downwardly directed high-pressure water nozzles 98 evenly spaced from each other in such a side-by-side manner as to register or line-up respectively with the central opening of a corresponding mold/mold support unit positioned in single-file abutting relation underneath manifold 90 on trackway 88. Thus, in the preferred embodiment illustrated, manifold 90 carries 30 evenly spaced downwardly facing nozzles arranged in single-file fashion parallel to trackway 88.

Accordingly, when the set of mold support units 16 from tray 66 is slidingly positioned on trackway 88 under manifold 90 substantially as shown in FIG. 5, a separate nozzle 98 will be adapted to direct a high pressure stream of hot water downwardly into the central recess of a corresponding mold 14, i.e. nozzle 98 and the central opening of the mold 14 will be aligned thereby facilitating washing of the mold interior.

As mentioned above, trackway 88 is of open construction. This preferred arrangement may be better understood by reference to FIG. 7 where bracket 100 supports a pair of spaced, parallel, longitudinally extending rails 102, 104; a first pair of spaced, parallel longitudinally extending siderails 106, 108; and a second pair of spaced, parallel longitudinally extending siderails 110, 112. Together rails 102, 104, 106, 108, 110 and 112 make up trackway 88 which extends horizontally from the end of shelf 86 adjacent pre-soak tub 70 through washing station 62 from right to left as seen in FIGS. 4 and 5 and terminates adjacent to drying station 64.

In addition to hot water manifold 90, and as mentioned above, hot water manifolds 92, 94, 96 are positioned in front of, behind and below trackway 8 with each being spaced therefrom and extending parallel thereto substantially as shown. Each of these additional manifolds carries four evenly spaced high pressure fluid nozzles 120, 122, 124, respectively, substantially as shown in FIGS. 4 and 5.

Although only one bracket 100 is shown, it will be appreciated that additional similar brackets may be provided in spaced longitudinal relation to each other to maintain trackway 88 securely in place with the brackets being suitably attached to a rigid supporting structure or framework not shown to avoid obfuscating the drawings. Also, it further will be appreciated that manifolds 90, 92, 94, and 96 are connected to suitable high pressure fluid supply lines or piping (not shown) in a manner well understood by those skilled in the art.

Figure 7:
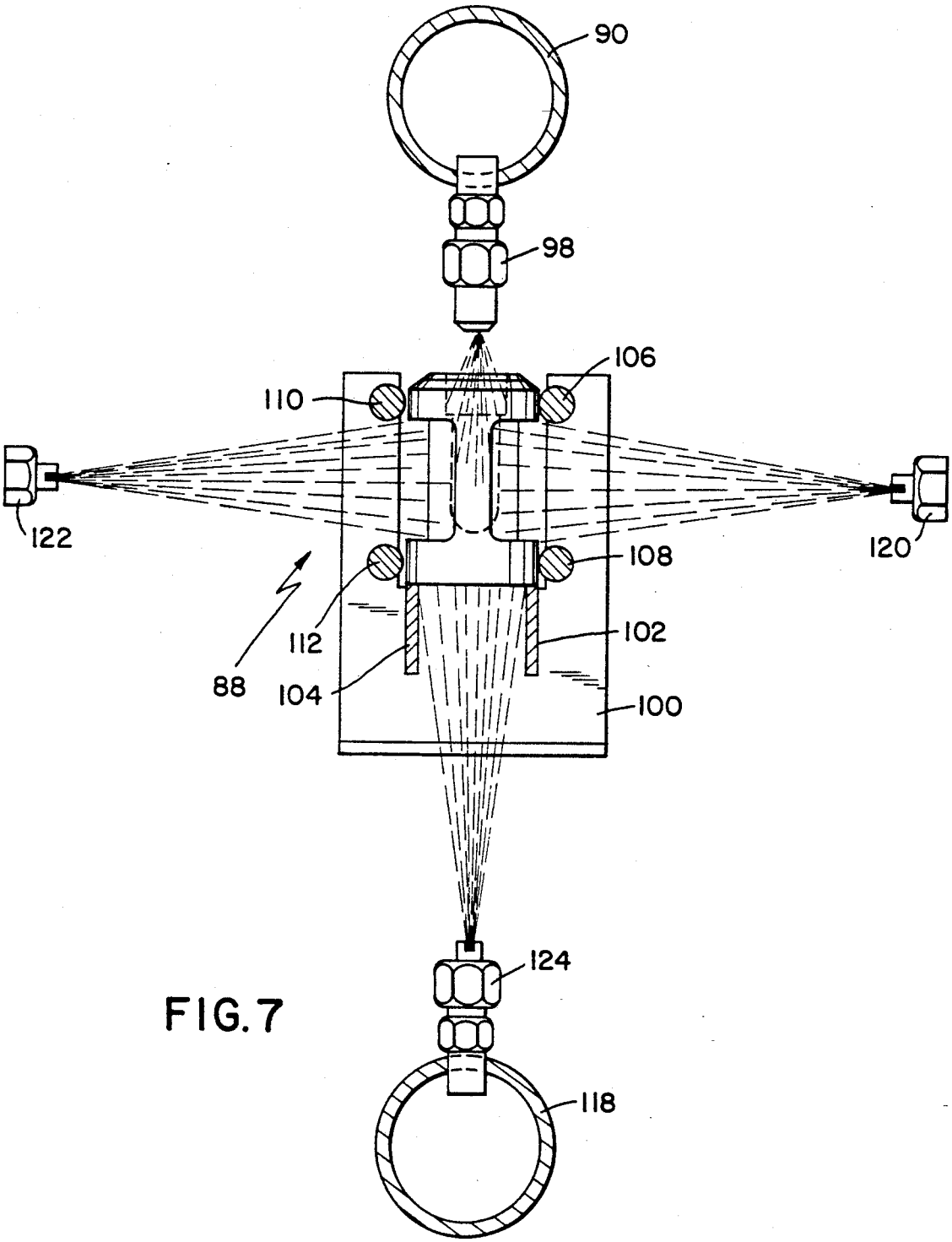
FIG. 7 is an enlarged sectional view taken along line 7—7 in FIG. 5.

In operation, an array of mold support units 16 contained in tray 66 on shelf 86 are slid single-file through the open end of the tray onto and along trackway 88 and brought to rest at a position underneath manifold 90 such that an individual downwardly facing nozzle 98 on manifold 90 registers or aligns with the central opening of a corresponding mold 14 (see FIGS. 4 and 7). In this position and as mentioned above, a high-pressure stream of hot water is adapted to be delivered into and through the central opening of the mold. Simultaneously, high pressure streams of hot water from manifolds 92, 94, and 96, and nozzles 120, 122, and 124 are adapted to impinge upon the sides and bottom of each mold and mold support unit. In this regard, it will be noted that the fluid streams from nozzles 120 and 120 are adapted to impinge against the sides of the molds and mold support units through the openings between spaced siderails 110, 112 whereas the fluid streams from nozzles 124 are adapted to impinge against the bottom of the mold support units through the opening defined by the space between bottom rails 102, 104. A basin 115 having a tile or other water impervious surface preferably is provided underneath trackway 88 to catch the water run-off from the nozzles. The floor of basin 115 is slanted toward a central drain for collecting the run-off and diverting it elsewhere.

As a result of the foregoing manifold and nozzle arrangement, surrounding streams of pressurized hot water may be directed against virtually every portion of each mold and mold support unit thereby washing off any caked pomade material, grime, or other debris. In order to assure the effectiveness of such washing cycle, the hot water streams from nozzles 98, 120, 122 and 124 are directed against the molds and mold support units for a sufficient time interval either by manual activation of an on-off valve or automatically via a conventional timer controlled valve. In the preferred embodiment, a wash cycle in the range of 1–3 minutes has been employed successfully.

Once the group of molds and mold support units has been washed in station 62, they then may be conveyed along trackway 88 to drying station 64 where they are adapted to be received within a second tray 66' identical in all respects to tray 66. In accordance with the invention, the second tray 66' is supported on the top surface 130 of a plenum chamber 132 located at drying station 64 with second tray 66' having its open end adjacent to and confronting the left most end of trackway 88 as viewed in FIGS. 4 and 5.

Optionally, an array of air supply nozzles 128 surrounding trackway 88 may suitably be supported between working station 62 and drying station 64 as schematically indicated in FIG. 5 for the purpose of directing streams of pressurized or compressed air against the molds and mold support units passing by on trackway 88. Such forced air streams will facilitate removal of residual water by blowing off large water droplets remaining on the units after the wash cycle. As will be appreciated by those skilled in the art, the air nozzles 128 preferably are connected to a source of pressurized air through suitable connecting lines (not shown) and may be operated manually through activation of a conventional on-off valve or, automatically, by a photocell sensor, microswitch or similar known valve activating device interacting with the units as they pass through the air nozzles on trackway 88 on their way to drying station 64.

Referring to FIG. 5, in addition to plenum 132, drying station 64 comprises a duct 136 for feeding forced, heated air through funnel shaped duct hood 138 integral therewith toward second tray 66' located on the top surface 130 of the plenum. For such purpose, duct hood 138, in turn, terminates in an integral, rectangularly shaped mouth section 139 sized and shaped to conform generally to the longitudinal and transverse dimensions of trays 66 (or 66').

As used herein, the term "longitudinal" means a direction in the plane of FIG. 5 parallel to surface 130 of plenum 132 whereas the term "transverse" means a direction perpendicular to the plane of FIG. 5 and parallel to top surface 130 of plenum 132.

A heat exchanger suitable for heating air and a fan or blower unit are mounted upstream on duct 136 and may be actuated by a suitable on-off switch to furnish a stream of forced heated air flowing through duct 136, hood 138 and rectangularly shaped mouth section 139. The details of the heat exchanger and blower unit are conventional and form no part of the present invention.

A movable sleeve assembly, generally designated by reference numeral 140, is supported for up and down slideable movement on the mouth section of duct 138 by a pair of horizontally opposed end extensions 142, 144 attached respectively to the opposite ends of assembly 140, each of which extension, in turn, is connected to a corresponding piston rod of a conventional air cylinder assembly 146, 148 suitably mounted on a pair of brackets 150, 152, attached respectively to either opposed end of rectangularly shaped mouth section 139 of duct 138 immediately above end extensions 142, 144.

As will be explained in further detail below, actuation of a conventional air control valve (not shown) is adapted to cause the piston rods of the air cylinders 146, 148 to simultaneously move downwardly or upwardly as viewed in FIG. 5 thereby causing the sleeve assembly 140 to slide downwardly or upwardly in a corresponding manner a predetermined distance relative to the mouth section of duct hood 138 and the top confronting surface 130 of plenum 132 both of which remain fixed relative to each other and to moveable assembly 140.

Figure 8:
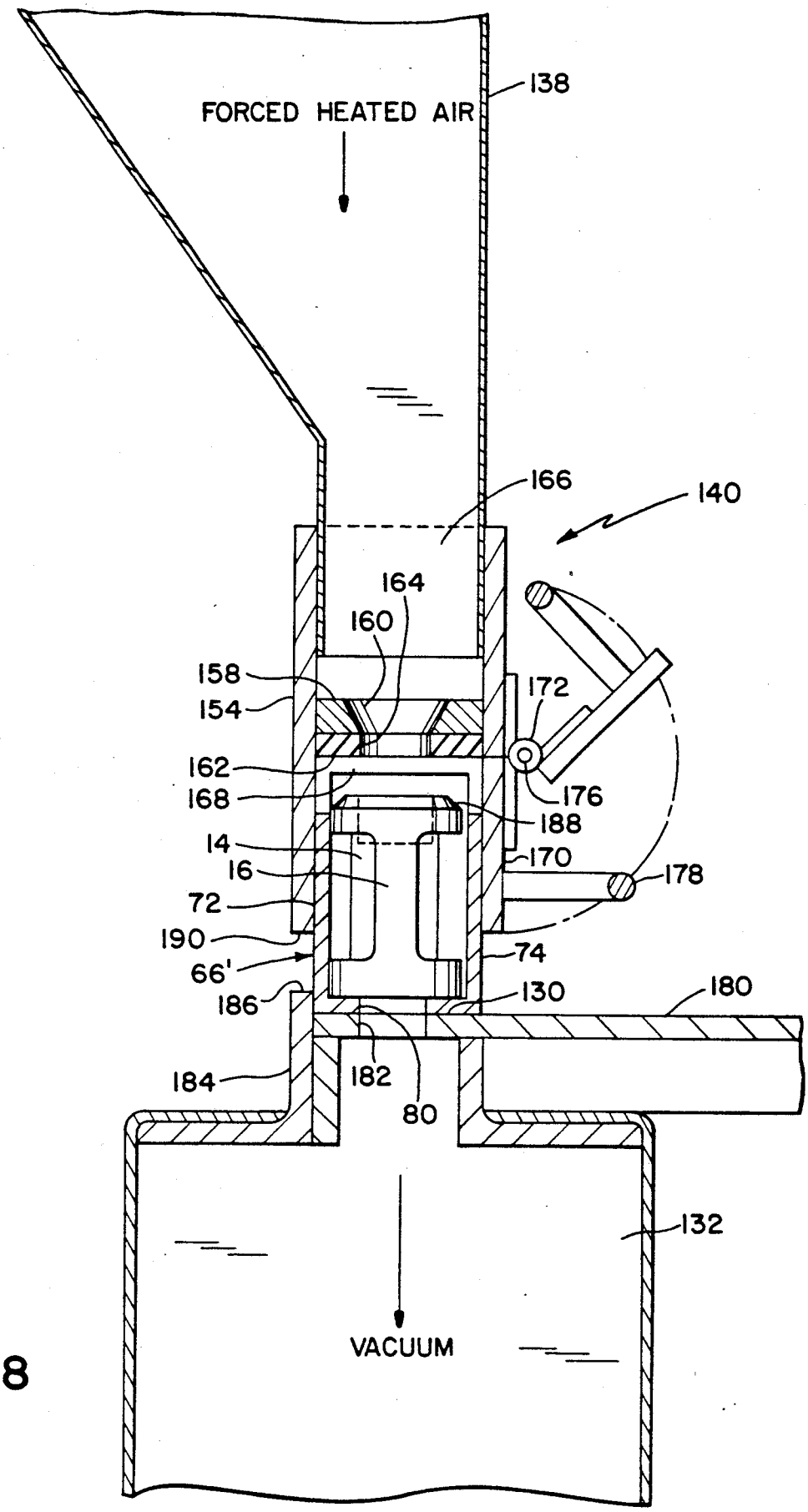
FIG. 8 is an enlarged sectional view taken along line 8—8 in FIG. 5.

As best seen in FIG. 8, movable sleeve assembly 140 comprises a back plate 154, a front plate 156, and a baffle plate 158 the short dimension of which extends transversely between plates 154, 156 parallel to surface 130 of plenum 132, and the long dimension of which extends longitudinally between plates 154, 156 parallel to surface 130 of plenum 132. Baffle plate 158 is rigidly fixed relative to front and back plates 154, 156 and therefore slides relative to duct 138 and the surface 130 of plenum 132 when the sleeve assembly moves through its range of motion from a first position to a second position. Baffle plate 158 has therein a series of evenly spaced, tapered apertures extending along its longitudinal dimension (i.e. perpendicular to the plane of FIG. 8), each one of which is adapted to line up with the central opening of a corresponding mold unit 14 and mold support unit 16 received in tray 66'. Attached to the bottom or under surface of baffle plate 158 and substantially coextensive therewith is a gasket 162 of resilient material (e.g. rubber) having a like series of apertures 164 evenly spaced along the longitudinal extent thereof, each of which registers with and corresponds to one of the apertures 160 in the baffle plate. The diameter of apertures 164 and of the narrow opening of apertures 160 is chosen to be slightly smaller than the central opening of depressible ring 32 on mold 14 and all three openings are adapted to be co-axially aligned with respect to each other when the mold support units are positioned in tray 66' within sleeve 140 as shown. Hence, it will be appreciated from FIG. 8 that heated air in duct 138 may flow through apertures 160, apertures 164 and impinge against the tops of molds 14 contained within second tray 66'.

Front plates 154, 156 and baffle plate 158 are fixedly secured at their opposite ends to a pair of end plates 165, 166 to which extensions 142, 144 respectively are attached as previously maintained. End plate 166 (i.e. the right-most end plate on assembly 140 as viewed in FIG. 5) has therein a suitable sized and shaped opening 168 (FIG. 8) for permitting mold support units on trackway 88 to be slid into and received by tray 66' when the latter is positioned on top surface 130 of plenum 132 substantially as shown in FIG. 8. Front plate 156 has a lower section 170 connected thereto via longitudinally extending hinge assembly 172 one half of which is fixed to front plate 156 and other lower half of which is fixed to lower plate section 170. A handle 178 fixed to lower plate section 170 thus permits the lower plate section to be pivoted upwardly about hinge axis 176 along parting line 174 to create an opening facilitating loading and/or unloading of tray 66' relative to sleeve assembly 140.

Plenum 132 has a top plate 180 defining upper surface 130 which, in turn, has a series of evenly spaced holes 182 therein extending longitudinally from the left end of the plenum to its right end as viewed in FIG. 5 with the evenly spaced apertures being approximately the same size as apertures 80 in the bottom of tray 66'.

Top plate 180 extends to the right substantially as shown in FIG. 8 to provide a support shelf for trays 66'. As depicted in FIG. 5, plenum 132 is supported immediately below ducts 138, 139 and movable assembly 140 by means of a suitable framework (not shown) and has fixed in its lower or bottom wall 141, a multiplicity city of identical, evenly spaced cylindrically-shaped ports 135 defining openings each of which is connected to a corresponding flexible hose 137 which in turn is coupled to the intake of a vacuum pump (not shown). In the preferred embodiment illustrated, four such vacuum pumps are employed the purpose of which is to apply a vacuum or suction within plenum 132 at the same time forced, heated air is being fed through ducts 136, 138 and rectangular mouth section 139. In this regard, any conventional "wet-dry" or so-called "shop vac" unit may be employed. A suitable such unit is available from Sears Roebuck & Company, model no. 9KY 17808C bearing the designation "Wet-Dri Vac."

Returning to FIG. 8, a stop plate 184 extending slightly above surface 130 and terminating in a top edge 186 extends longitudinally and substantially entirely along the rear of top plate 180 to define a shoulder which serve as a transverse locating stop or guide for the sidewall 72 of tray 66'. A similar stop member 185 extends transversely along the left-most edge of top plate 180 and serves as a shoulder to locate the longitudinal position of tray 66' on surface 130 (see FIG. 4). Hence, when lower plate section 170 is pivoted to its upper or open position via handle 178 and hinge 172, an empty tray 66' may be disposed within sleeve assembly 140 and underneath duct hood 138 by sliding same on and along surface 130 until the tray's sidewall 72 and endwall 76 abut against the aforementioned locating stops 186, 187 whereupon tray 66' will occupy the position shown in FIG. 8 such that each of its apertures 80 is co-axially aligned with a corresponding aperture 182 in top plate 180.

It will be noted that when the lower plate section 170 is pivotally returned to its down or closed position, it abuts against the sidewall 74 of tray 66' whereas back plate 154 abuts against the opposed sidewall 72 of the tray. Thus tray 66' is substantially sealingly enclosed within movable sleeve assembly 140 following pivotal return of plate section 170 to its normal downward position as viewed in FIG. 8.

After an empty tray 66' has been so located within sleeve assembly 140, a group of washed molds and mold support units exiting washing station 62 on trackway 88 may slidingly be received within tray 66 by movement thereof through doorway 168 sufficient to cause the group of units to line up in single-file abutting arrangement within tray 66' with the central axis and opening of each such mold and mold support unit being co-axially aligned with a corresponding set of similarly aligned apertures 80 (tray 66') and 182 (top plate 180).

Drying apparatus 64 may then be activated (i.e. turned on) by furnishing forced, heated air to ducts 136, 138 and applying a vacuum to plenum 132. Likewise, in accordance with the invention, air cylinders 146, 148 may simultaneously or in sequence be activated to cause slideable displacement of movable assembly 140 downwardly a distance sufficient to cause the resilient gasket 162 on the underside of baffle plate 158 to engage the depressible ring 32 on each mold in tray 66'. By this action, the molds 14 carried by all mold support units in tray 66' simultaneously will be cammed open, and the forced, heated air from duct 138 will be caused to flow through apertures 160 and baffle plate 158, apertures 164, and gasket 162, the open molds 14, the central openings in the hollow cylindrical lower body portions of mold support units 16, apertures 80 in tray 66', and finally, apertures 182 in top plate 180 of plenum 132.

Preferably, assembly 140 is caused to move downwardly in such manner until gasket 162 engages the top surface 47 of mold support units 16 at which point ring 32 will be depressed sufficiently to cam open mold halves 18, 20. In this position, the gasket 162 will effectively seal against the flow of heated air around the top and exterior side portions of the various mold support units contained within tray 66', i.e. substantially all of the air will be confined to flow through the open mold 14 and the aforementioned path thereby effectively drying the interior of each mold unit. To assure proper engagement between the gasket 162 and the top surface 47 of each mold support unit 16, the distance between bottom surface 190 of plate 154 and top surface 186 of stop plate 184 is made to be slightly longer than the extent or range of motion of assembly 140 desired. Without limiting the present invention, it has been found that about 0.5 inches of movement of assembly 140 is all that is necessary between a first position as shown in FIG. 8, and a second position where gasket 162 adequately engages the top surface 147 of each mold support unit in tray 66' and therefore depresses each ring 32 sufficiently to cam open all of the mold units in tray 66'.

It will be appreciated that the application of a vacuum in plenum 132 during the passage of forced, heated air through the molds and mold support units as described above accelerates the flow of hot air thereby decreasing the time it takes to completely and effectively dry the molds and/or mold support units. Hence, by applying a vacuum suction via plenum 132 in accordance with the invention, drying of molds 14 and mold support units 16 is accomplished more rapidly and more effectively than would otherwise be the case if only the application of forced, heated air via duct 136 were to be relied upon.

In utilizing the drying apparatus of the present invention, a split or two part drying cycle preferably is used to produce even more effective and complete drying of molds 14 and mold support unit 16. That is, after an initial period of time when the flow of forced, heated air is confined through the open molds 14 as determined by movement of assembly 140 downwardly into its second or engaged position, the movable sleeve assembly 140 may be returned to its first, or normally non-engaged position (FIG. 8) during a subsequent or second period of time during which the forced, heated air is allowed to continue to flow over the molds and mold support units in tray 66'. When this occurs, i.e. when the molds 14 are in their closed position, the heated air will flow around the tops and exterior side portions of the mold support units thereby facilitating complete drying of these parts.

Accordingly, the present invention contemplates a two phase drying cycle; the first phase of which being defined as when the baffle plate 158 carried by movable assembly 140 has moved into engagement with the molds contained in tray 66' so as to maintain them in their open condition, and the second phase being defined as when movable assembly 140 is returned upwardly to its non-engaged position substantially as shown in FIG. 8. Of course, it will be understood that the order of sequence of these two phases is not critical and that either phase may precede the other in priority. Similarly the time duration of each phase is not critical, it being necessary merely that forced, heated air be furnished in ducts 136, 138, etc. while a vacuum is applied to plenum 132 for a sufficient duration of time to adequately dry the interior and exterior portions of the molds and mold support units carried in tray 66' positioned in the drying station 64.

To illustrate without limiting the present invention, drying cycle intervals in the range of 0.5 to 1.5 minutes have been successfully employed for each phase utilizing forced air (1,000 CFM) at a temperature in the range of 140° F. to 160° F. while a vacuum suction of 1,200 CFM is applied within plenum 132.

Figure 9:
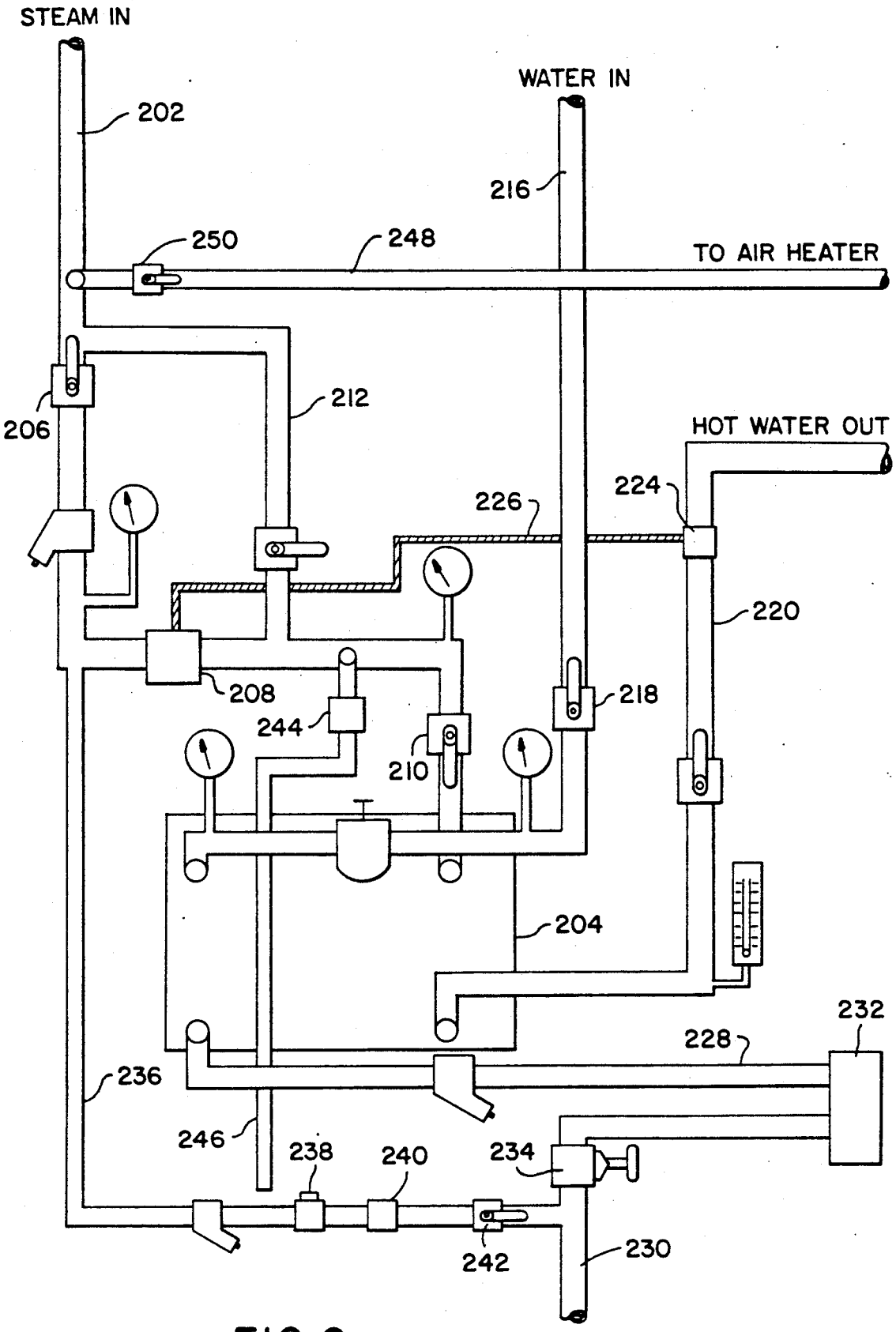
FIG. 9 is a schematic piping diagram showing the preferred form of apparatus employed to furnish hot water and hot air used in the present invention.

In practicing the present invention, any convenient source of energy may be employed to furnish the forced, heated air to drying station 64 and the hot water to washing station 62. The preferred arrangement is shown in FIG. 9 and comprises a source of steam made available on main steam line 202 from a conventional steam boiler (not shown). Main steam line 202 is connected to the input side of a conventional steam/water heat exchanger 204 through on-off valve 206, pressure regulator 208, and another on-off valve 210. A shunt o by-pass line 212 connects line 202 to the input of heat exchanger 204 through on-off valve 24. Water fed along input line 216 to heat exchanger 204 through on-off valve 217 and pressure regulator 218, is heated by the steam in the heat exchanger and exits along output line 220 through on-off valve 222. The hot water output line 220 is connected to manifolds 90, 92, 94, and 96 for supplying hot water at washing station 62. A thermocouple 224 senses the temperature in line 220 and sends a control signal back to pressure regulator 208 along feedback line 226 to maintain the temperature of the water made available along line 220 more or less constant via appropriate adjustment of the input steam pressure to heat exchanger 204. Steam and condensate exit heat exchanger 204 along line 228 and are returned to the steam boiler via main steam return line 230 though steam and condensate valve 232 and on-off valve 234. Condensate from the input line 202 may be routed directly to return line 230 via condensate by-pass line 236, condensate valve 238, one-way valve 240, and on-off valve 242. In the event of unusual pressure build-up in input line 202, pressure relief may be afforded through pressure relief valve 244 and pressure relief outlet line 246. In order to supply steam to the steam/air heat exchanger in duct 136, a branch line 248 is connected to main steam input line 202 through on-off valve 250. Preferably, the configuration of FIG. 9 is operated to produce hot water on line 220 having a temperature in the range of about 190° F. to about 195° F. whereas the steam temperature on branch line 248 should be hot enough to maintain the temperature of the air in duct 136 within the range of about 140° F. to about 160° F.

Once heated air is made available to duct 136 of drying station 64 and hot water is made available to the various manifolds and nozzles of washing station 62, all that is necessary is to control the operation of these units either manually, or in an automatically timed manner employing conventional on/off switches and/or relay timers located conveniently such as at the control box location designated by reference numeral 230 in FIG. 4. The operational and constructional details of such switches and timers is well understood in the art and outside the scope of the present invention. It is sufficient merely to point out in this regard that the supply of hot water to washing station 62; the supply of forced, heated air and the application of a vacuum suction to drying station 64; as well as the operation of air cylinders 146, 148 may be carried out either manually through activation of corresponding on-off switches or valves, or automatically through appropriate timing or programming means which in turn activate such on-off switches or valves in a manner well known and understood in the art.

Although trackway 88 serially connects washing station 62 to drying station 64, it will be appreciated that while a group of mold/mold support units is being dried in drying station 64, a similar number of other mold-/mold support units may be washed simultaneously at washing station 62 thereby efficiently cleaning a maximum number of units per given unit of time. Thus, in practicing the cleaning method of the present invention, a continuous line of mold support units should be on trackway 88. Once a tray 66' of cleaned and dried mold support units has been removed from its position between sleeve assembly 140 and plenum 13 of drying station 64 via pivotal plate 170, and a new empty tray 66' reinserted into position against longitudinal and transverse stops 184, 185, slidable insertion of a like number of mold support units from tray 66 on shelf 86 onto trackway 88 may be effected thereby causing those mold support units already on trackway 88 to move to the left as viewed in FIG. 5, i.e. the units waiting to be dried between the washing station and the drying station will be moved into the empty tray 66' positioned within sleeve assembly 140 much like a line of railroad cars being moved along its track by an engine in the rear. The operator may then actuate the washing station and the drying station through manipulation of the appropriate on-off switches and/or relays contained in control box 230, repeating the process after each drying cycle. Finally, completely cleaned and dried mold-/mold support units may be removed from drying station 64 in their corresponding tray 66', placed on an off-loading trolley wagon 68 located adjacent drying station 64 and eventually returned to the lipstick line of FIG. 1.

And although the preferred form of apparatus and the preferred method according to the present invention have been described in detail above with reference to the mold and mold support units shown in FIG. 2, it will be appreciated that the workpiece holders 52 may be similarly cleaned and dried utilizing the same apparatus. While in such event there is no depressible ring or mold to be opened, engagement of the gasket on baffle plate 158 with the top surface of each workpiece holder via movement of movable sleeve assembly 140 to its second or engaged position will still be effective to facilitate drying of the interior portions of the workpiece holder's upper body portion.

Likewise, it is within the contemplation of the present invention to provide means similar to movable sleeve assembly 140 at washing station 62 wherein the split-molds 14 in their mold support units 16 may be engaged and activated to an open condition thereby enabling hot water from at least manifold 90 and nozzles 98 to flow through the top opening of the molds and mold support units while the molds are open as such modification will result in even more complete washing action especially along the parting line portions of the split molds.

Hence, it is evident that many variations and modifications of the present invention may be made without departing from the principles disclosed hereinabove. Accordingly, the present invention should be limited only by the true spirit and scope of the annexed claims.

We claim:

1. Apparatus for cleaning a multiplicity of tubular articles comprising a washing station, a drying station, means for conveying said multiplicity of tubular articles from said washing station to said drying station, said drying station having means associated therewith for applying heated air against said articles in a first direction, and said drying station having further means for applying a vacuum against said articles in a second direction simultaneously during the application of said heated air.

2. The apparatus of claim 1 wherein said drying station comprises means for supporting said multiplicity of tubular articles between said heated air application means and said vacuum application means.

3. The apparatus of claim 2 further comprising means for confining the flow of said heated air through the center of said tubular articles.

4. The apparatus of claim 3 wherein said confining means comprises means cooperatively associated with said heated air application means and said means for supporting said articles.

5. The apparatus of claim 4 wherein said supporting means comprises a tray disposed on a portion of said drying station and said heated air application means comprises a duct spaced from said tray and said confining means comprises a sleeve mounted on said duct and surrounding said tray, said confining means further including means for causing said sleeve to move between a first position and a second position, said heated air in said duct being adapted to flow through the center of said tubular articles in said tray when said sleeve is in said second position.

6. The apparatus of claim 5 wherein said tray includes a first series of apertures therein communicating with the center of each tubular article respectively, and said means for applying a vacuum comprises a second series of apertures in said portion of said drying station supporting said tray, and said apparatus further comprises vacuum pump means communicating with said first and second series of apertures.

7. The apparatus of claim 5 wherein said confining means includes an opening therein, and said conveying means is adapted to deliver said tubular articles from said washing station to said tray supported on a portion of said drying station through said opening in said confining means.

8. The apparatus of claim 7 wherein said washing station comprises a plurality of nozzles for directing hot water against said multiplicity of tubular articles when they are supported on said conveying means, and said means for directing heated air and for applying a vacuum are operative simultaneously with respect to a different multiplicity of tubular articles formerly exposed to hot water from said nozzles at said washing station.

9. Apparatus for cleaning a multiplicity of tubular articles wherein each of said articles comprises a pair of separable portions activatable with respect to each other by cam means between a first closed condition and a second open condition, said portions abutting each other in said first closed condition and being spaced from each other in said second open condition, respectively, said apparatus comprising means for supporting said articles in said first closed condition at a first location, means for conveying said articles to a second location spaced from said first location to effect a cleaning operation, and means at said second location engagable with said cam means on each of said articles to thereby activate said separable portions to said second open condition whereby cleaning of said tubular articles is facilitated.

10. The apparatus of claim 9 wherein means are provided at said second location for applying hot water to said articles while they are in said open condition.

11. The apparatus of claim 9 wherein means are provided at said second location for applying heated air to said articles while they are in said open condition.

12. The apparatus of claim 11 wherein means are provided at said second location for applying a vacuum to one end of said articles while said articles are in their open condition and said means for applying heated air applies same to another end of said articles.

13. The apparatus of claim 10 wherein means are provided at said second location for supporting said articles in single-file abutting relation.

14. The apparatus of claim 13 wherein said means for supporting said articles comprises a tray having one closed end and one open end and said articles are adapted to be received within said tray through said open end.

15. The apparatus of claim 14 wherein said tray has a series of apertures in the bottom thereof, said means for applying heated air to said articles is located above said tray, and said means for applying said vacuum is located below said tray and communicates with said articles in their open condition through said apertures in said tray bottom.

* * * * *